US006902469B2

(12) United States Patent
Kondo et al.

(10) Patent No.: US 6,902,469 B2
(45) Date of Patent: Jun. 7, 2005

(54) WORK CHAMFERING APPARATUS AND WORK CHAMFERING METHOD

(75) Inventors: Sadahiko Kondo, Takarazuka (JP); Toshifumi Hiyoke, Muko (JP)

(73) Assignee: Neomax Co., Ltd., Osaka (JP)

( * ) Notice: Subject to any disclaimer, the term of this patent is extended or adjusted under 35 U.S.C. 154(b) by 0 days.

(21) Appl. No.: 09/747,971

(22) Filed: Dec. 27, 2000

(65) Prior Publication Data

US 2001/0006876 A1 Jul. 5, 2001

(30) Foreign Application Priority Data

Dec. 28, 1999 (JP) ..... 11-372957

(51) Int. Cl.[7] ..... B24B 9/06
(52) U.S. Cl. ..... 451/44; 451/366
(58) Field of Search ..... 451/396, 402, 451/41, 43, 44, 385, 398, 365, 28, 226, 229, 255–256, 366, 384; 125/35

(56) References Cited

U.S. PATENT DOCUMENTS

| | | | | | |
|---|---|---|---|---|---|
| 2,551,648 | A | * | 5/1951 | Suben | 451/385 |
| 2,644,277 | A | * | 7/1953 | Chatten | 451/385 |
| 4,778,730 | A | * | 10/1988 | Zucker | 428/552 |
| 5,009,038 | A | * | 4/1991 | Yoshikawa et al. | 451/229 |
| 5,036,624 | A | | 8/1991 | Steere, Jr. | 51/106 |
| 5,295,331 | A | * | 3/1994 | Honda et al. | 451/44 |
| 5,445,554 | A | | 8/1995 | Hosokawa | 451/11 |

FOREIGN PATENT DOCUMENTS

| | | | | |
|---|---|---|---|---|
| DE | 0938216 | * | 1/1956 | 451/226 |
| DE | 3706886 | * | 9/1988 | 451/44 |
| EP | 0 686 460 | | 12/1995 | |
| GB | 2126008 | * | 3/1984 | 451/44 |
| GB | 2 337 712 A | | 12/1999 | |
| JP | 60-207755 | | 10/1985 | |

(Continued)

OTHER PUBLICATIONS

Publication for the corresponding Philippine Patent Application No. 1–2000–03605; Patent Applns. Published Pursuant To Sec. 44 of Republic Act 8293; pp. 209–210.

Notification of Reasons for Refusal, relating to corresponding Appln No. 2000–390043, dispatch date Mar. 30, 2004, with partial translation.

Office Action to the corresponding Chinese Application No. 00137066.9 with translation dated Sep. 24, 2004.

Notification of Reason(s) for Refusal dated Aug. 24, 2004 to the corresponding Japanese Patent Application No. 2000–390043 (& Partial Translation thereof).

*Primary Examiner*—Robert A. Rose
(74) *Attorney, Agent, or Firm*—Armstrong, Kratz, Quintos, Hanson & Brooks, LLP

(57) ABSTRACT

A work chamfering apparatus includes a work holding portion. The work holding portion includes a work table and a clamper. The work table has an upper surface having two end portions each formed with holding grains projecting out of the upper surface. The two end portions of the upper surface of the work table have a static friction coefficient greater than 0.1, which is greater than that of a center portion. When chamfering, first, the work is held by the work table and a generally U-shaped member of the clamper. At this time, the two end portions of the upper surface of the work table contact a lower surface of the work, whereas lower surfaces of respective end portions of the U-shaped member contact an upper surface of the work. In this state, a rotating center of the work is between the lower surfaces, and the lower surfaces are apart generally equally from the rotating center. Next, a tool including a first grinding stone and a second grinding stone is lowered, and the first grinding stone chamfers an upper edge of the work. Then, the tool is moved off and raised, and then the second grinding stone chamfers a lower edge of the work.

13 Claims, 8 Drawing Sheets

U.S. PATENT DOCUMENTS

| | | |
|---|---|---|
| JP | 61-166746 | 10/1986 |
| JP | 62-40760 | 10/1987 |
| JP | 4-146066 | 5/1992 |
| JP | 5-337716 | 12/1993 |
| JP | 6-226574 | 8/1994 |
| JP | 6-262505 | 9/1994 |
| JP | 10-193239 | 7/1998 |
| JP | 10-315107 | 12/1998 |
| JP | 11-320231 | 11/1999 |

* cited by examiner

Relationship between Grinding Stone Rotating Speed and Chipping

| Grinding stone rotating speed (rpm) | 500 | 1000 | 2000 | 3000 | 4000 | 5000 | 6000 | 7000 |
|---|---|---|---|---|---|---|---|---|
| Grinding stone circumferential speed (m/min) | 31.4 | 62.8 | 125.6 | 188.4 | 251.2 | 314 | 376.8 | 439.6 |
| Number of chippings (Diameter≧1mm) | 20 | 15 | 10 | 8 | 5 | 10 | 35 | Seizure |

WORK CHAMFERING APPARATUS AND WORK CHAMFERING METHOD

BACKGROUND OF THE INVENTION

1. Field of the Invention

The present invention relates to a work chamfering apparatus and a work chamfering method, and more specifically to a work chamfering apparatus and a work chamfering method for chamfering a thin work.

2. Description of the Related Art

As a related art of this kind, a chamfering apparatus is disclosed in the Japanese Patent Laid-Open No. 5-337716. This chamfering apparatus has a bearing tube having two ends each provided with a tool. The tools respectively grind an upper edge and a lower edge of the work, thereby chamfering both upper and lower edges of the work simultaneously.

However, since the bearing tube cannot have a thickness smaller than 3 mm, the related art chamfering apparatus cannot chamfer a thin work having a thickness smaller than 3 mm.

Further, a thin work may be bonded by adhesive so that the work can be held firmly during the chamfering. However, this method is time consuming, posing a problem of poor productivity.

SUMMARY OF THE INVENTION

It is therefore a primary object of the present invention to provide a work chamfering apparatus and a work chamfering method capable of chamfering efficiently even if the work is thin.

According to an aspect of the present invention, there is provided a work chamfering apparatus for chamfering a work, comprising: a work holding portion including a first surface and a second surface respectively contacting a main surface and another main surface of the work, for holding the work; wherein the first surface includes a portion having a static friction coefficient greater than 0.1.

According to another aspect of the present invention, there is provided a work chamfering method using a work holding portion including a first surface and a second surface, in which the first surface includes a portion having a static friction coefficient greater than 0.1. The method comprises a first step of holding the work with the work holding portion by contacting each of the first surface and the second surface with a main surface and another main surface of the work; and a second step of chamfering the work by using a tool.

According to the present invention, since the first surface of the work holding portion has a portion having a static friction coefficient greater than 0.1, it becomes possible to increase holding force to the work. Therefore, even if the work is a thin piece which is difficult to hold, it becomes possible to reduce unwanted movement during the chamfering, and to perform the chamfering while holding the work stably. Further, since there is no need for bonding the work, working time can be shortened, making possible to chamfer efficiently.

Preferably, the portion having the static friction coefficient greater than 0.1 is formed at two end portions of the first surface, and the two end portions contact the work. In this case, since the work is held by the two end portions having a large static friction coefficient, it becomes possible to provide a plurality of regions having large holding force to the work between the first surface and the work, making possible to further reduce the unwanted movement of the work during the chamfering.

Further, preferably, the portion having the static friction coefficient greater than 0.1 has a holding grain projecting out of the first surface. In this case, when the work is held by the work holding portion, it becomes possible to make the portion having the static friction coefficient greater than 0.1 stick into the work. Therefore, even if the pressing force of the work holding portion applied to the work is smaller than convention, the unwanted movement of the work can be reduced due to anchor effect.

According to still another aspect of the present invention, there is provided a work chamfering apparatus for chamfering a work, comprising: a work holding portion including a first surface and a second surface respectively contacting a main surface and another main surface of the work, for holding the work; wherein the first surface includes a center portion and two end portions, each of the two end portions having a static friction coefficient greater than that of the center portion, the two end portions contacting the work.

According to still another aspect of the present invention, there is provided a work chamfering method using a work holding portion including a first surface and a second surface, in which the first surface includes a center portion and two end portions and each of the two end portions having a static friction coefficient greater than that of the center portion. The method comprises: a first step of holding the work with the work holding portion by contacting each of the two end portions of the first surface with a main surface of the work and contacting the second surface with another main surface of the work; and a second step of chamfering the work by using a tool.

According to the present invention, the first surface has two end portions having a static friction coefficient greater than that of the center portion, and the work is held by these end portions. Therefore, it becomes possible to provide a plurality of regions having large holding force to the work. Thus, even if the work is thin and difficult to hold, the unwanted movement of the work can be reduced by the stable holding force during the chamfering. Further, since there is no need for bonding the work, the working time can be shortened and the chamfering can be made efficiently.

Preferably, the second surface contacts the work at a plurality of locations, with a center of rotation of the work in between. In this case, since the work can be held evenly on a good balance, the unwanted movement of the work during the chamfering can be reduced.

Further, preferably, the work chamfering apparatus comprises a first grinding stone and a second grinding stone for chamfering one edge and another edge of the work respectively as the tool, and a driving portion for moving the first grinding stone and the second grinding stone thickness-wise of the work.

In this case, after the work is held by the work holding portion, one edge of the work is chamfered by the first grinding stone. Then, the first grinding stone and the second grinding stone are moved, and the second grinding stone chamfers the other edge of the work. Therefore, a variety of works having a different thickness can be chamfered easily.

Conventionally if the work is a R—Fe—B alloy containing cobalt at a rate not smaller than 0.3 wt % and not greater than 10 wt %, chipping is increased and uniform chamfering is difficult, for the work is fragile. However, according to the present invention, since holding force to the work can be increased, even if the work is such a fragile piece, the work can be held stably, chamfered easily, and chipping can be reduced.

If the rotating speed of the grinding stone is slower than 2000 rpm, machining load of the grinding stone is large, resulting in an increased number of chippings of the work. If the rotating speed of the grinding stone is faster than 5000 rpm, a coolant is not supplied to a grinding edge enough, the number of chippings increases, too. Therefore, the rotating speed of the grinding stone is preferably not slower than 2000 rpm and not faster than 5000 rpm.

Further, if the circumferential speed of the grinding stone is slower than 125.6 m/min, the machining load of the grinding stone is large, resulting in an increased number of chippings of the work. If the circumferential speed of the grinding stone is faster than 314 m/min, the number of chippings increases, too. Therefore, the circumferential speed of the grinding stone is preferably not slower than 125.6 m/min and not faster than 314 m/min.

According to another aspect of the present invention, there is provided a chamfering method for chamfering a rare-earth sintered magnet by using a rotating grinding stone, wherein the grinding stone is rotated at a speed not slower than 2000 rpm and not faster than 5000 rpm and relative speed of the grinding stone with respect to an outer circumferential portion of the rare-earth sintered magnet is not slower than 0.5 mm/sec and not faster than 7.0 mm/sec, for chamfering the rare-earth sintered magnet.

According to still another aspect of the present invention, there is provided a chamfering method for chamfering a rare-earth sintered magnet by using a rotating grinding stone, wherein the grinding stone is rotated at a circumferential speed not slower than 125.6 m/min and not faster than 314 m/min and relative speed of the grinding stone with respect to an outer circumferential portion of the rare-earth sintered magnet is not slower than 0.5 mm/sec and not faster than 7.0 mm/sec, for chamfering the rare-earth sintered magnet.

In the case where the grinding stone is rotated at a speed not slower than 2000 rpm and not faster than 5000 rpm, and in the case where the grinding stone is rotated at the circumferential speed not slower than 125.6 m/min and not faster than 314 m/min, if the relative speed of the grinding stone with respect to the outer circumferential portion of the rare-earth sintered magnet is slower than 0.5 mm/sec, the grinding efficiency goes down, on the other hand, if the relative speed is faster than 7.0 mm/sec, the grinding stone exerts large machining load, resulting in an increased number of chippings in the rare-earth sintered magnet. According to the present invention, by setting the relative speed of the grinding stone within a range not slower than 0.5 mm/sec and not faster than 7.0 mm/sec, the number of chippings can be reduced and the chamfering can be performed efficiently.

If an average diameter of an abrasive grain is smaller than 100 $\mu$m, the grinding stone is clogged easily by sludge produced during chamfering. Furthermore, the abrasive grain wears prematurely, thereby reducing the productivity. On the other hand, if the average diameter of the abrasive grain is greater than 270 $\mu$m, the number of chippings increases when a fragile work such as a rare-earth sintered magnet is chamfered, since the diameter of the abrasive grain is too large. Especially, Such a problem is apt to occur in the case of a thin work. Therefore, preferably, the grinding stone includes the abrasive grain having the average diameter not smaller than 100 $\mu$m and not greater than 270 $\mu$m.

Preferably, a coolant having a surface tension not smaller than 25 mN/m and not greater than 60 mN/m is supplied to a grinding region. In this case, the coolant has a good permeability to a grinding edge of the grinding stone, improving grinding efficiency.

The present invention is especially effective if the rare-earth sintered magnet contains cobalt at a rate not smaller than 0.3 wt % and not greater than 10 wt %.

It should be noted here that in this specification, the term "chamfering" means to chamfer sequentially along an outer circumferential portion of a work, and includes copy chamfering and profile chamfering for example.

The above object, other objects, characteristics, aspects and advantages of the present invention will become clearer from the following description of embodiments to be presented with reference to the accompanying drawings.

DETAILED DESCRIPTION OF THE PREFERRED EMBODIMENTS

Hereinafter, an embodiment of the present invention will be described with reference to the accompanying drawings.

Figure 1:
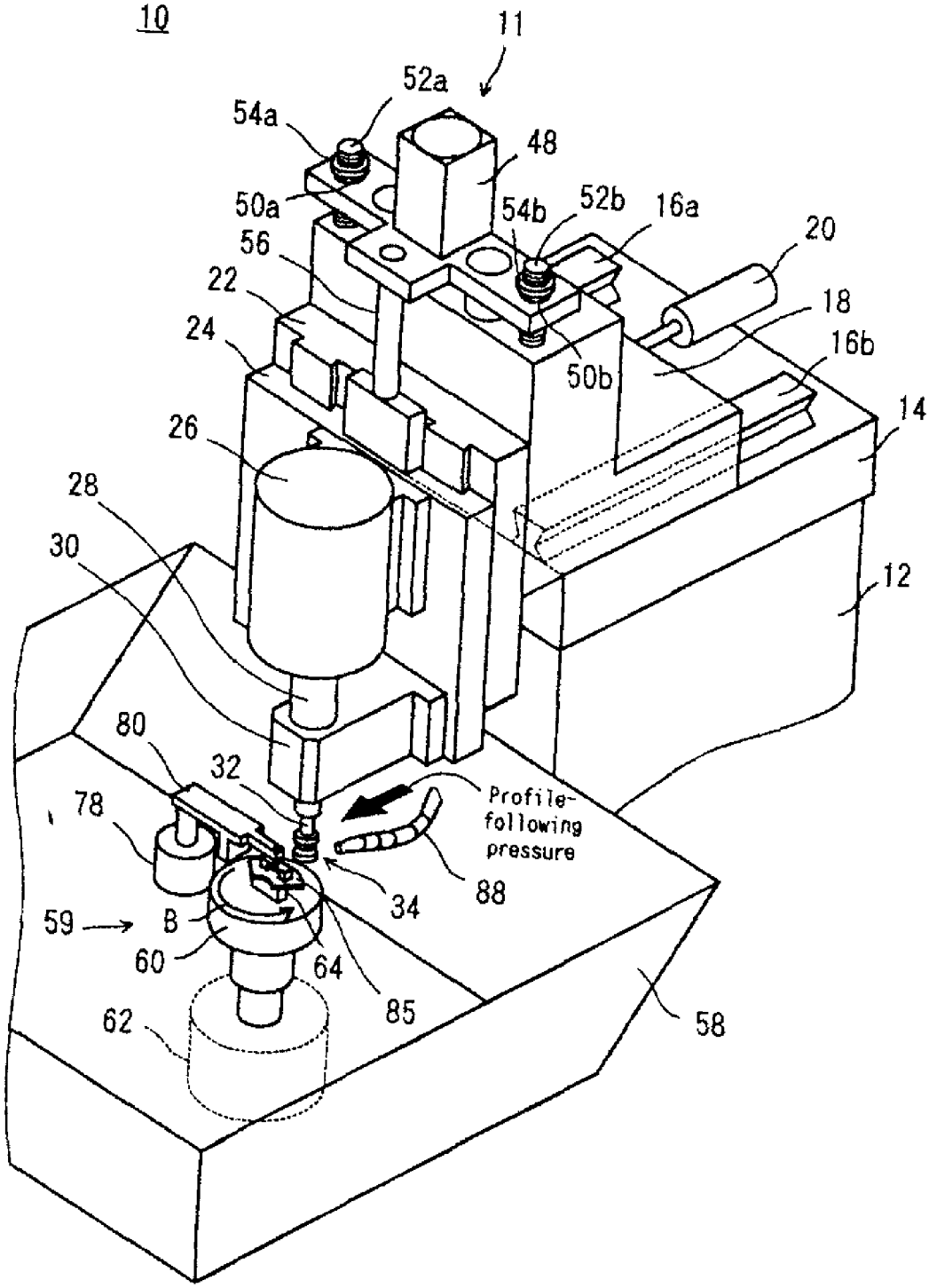
FIG. 1 is a perspective view showing an outline of an embodiment of the present invention.

Referring to FIG. 1, a work chamfering apparatus 10 as an embodiment of the present invention comprises a driving portion 11 for driving a tool 34 (to be described later). The driving portion 11 includes a base 12. The base 12 has an upper surface provided with a bed 14. The bed 14 has an upper surface provided with a pair of rails 16*a*, 16*b* parallel to each other. On the rails 16*a*, 16*b*, a generally L-shaped column 18 is disposed movably in horizontal directions. The column 18 is driven by a profile-following cylinder 20. The tool 34 is adjusted so as to chamfer at a predetermined constant profile-following pressure not smaller than 20 N and not greater than 30 N for example, as far as moving horizontally within a stroke range of the profile-following cylinder 20.

The column 18 has a front surface provided with a slide 22 for vertically moving a grinding stone shaft 32 (to be described later). The slide 22 is mounted with an electric motor attaching portion 24 slidably in vertical directions. The motor attaching portion 24 is provided with a grinding stone shaft motor 26. The grinding stone shaft motor 26 is provided with a bearing 28 extending downwardly from a lower end of the grinding stone shaft motor 26 and held by a bearing holding portion 30. The grinding stone shaft 32 is held by the bearing 28 and has a tip mounted with the chamfering tool 34. With this constitution, the grinding stone shaft motor 26 rotates the grinding stone shaft 32 and the tool 34 in a direction indicated by Arrow A (See FIG. 3.) at 3600 rpm for example.

Figure 2:
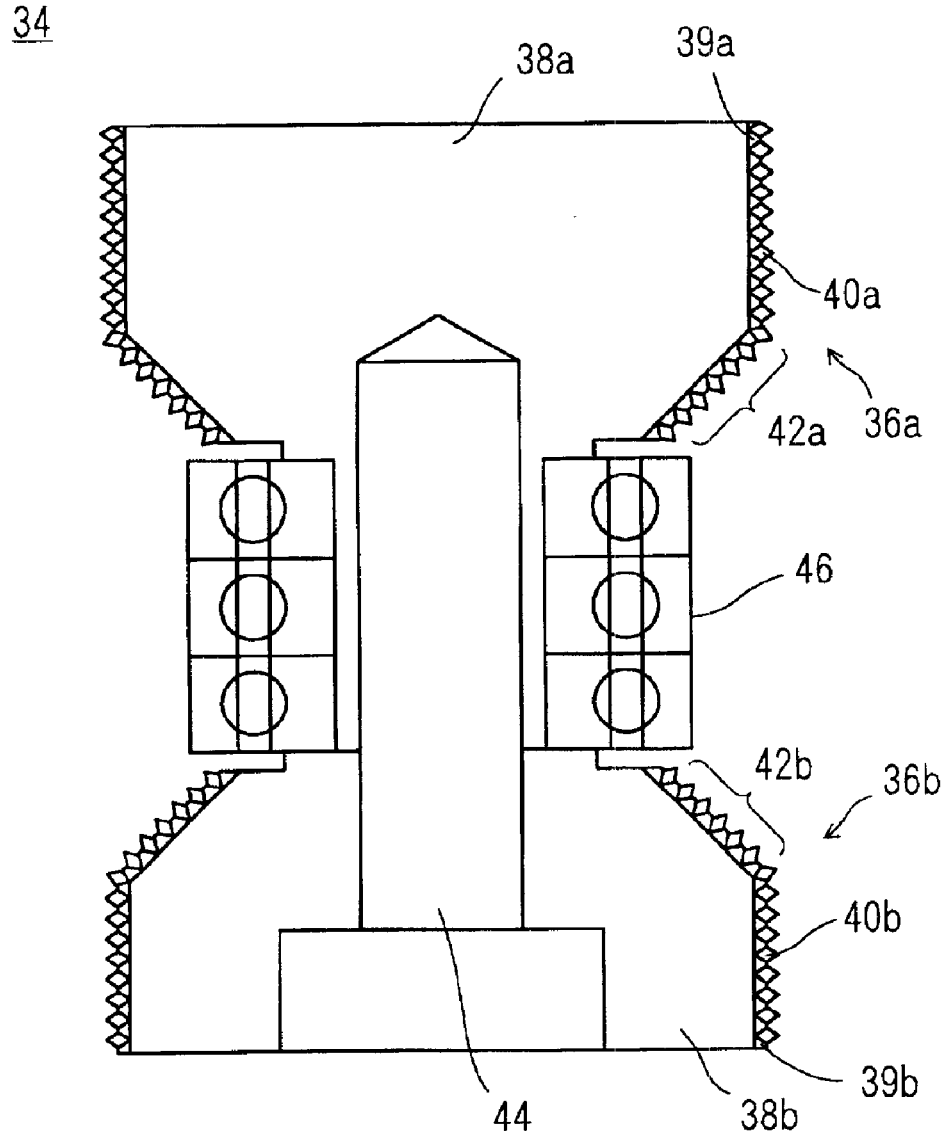
FIG. 2 is a diagram showing an example of a tool.

As shown in FIG. 2, the tool 34 includes grinding stones 36*a*, 36*b*. The grinding stones 36*a*, 36*b* respectively includes base members 38*a*, 38*b* made of iron for example. The base members 38*a*, 38*b* have respective surfaces formed with abrasive grains 40*a*, 40*b* such as diamond abrasive grains rendered by electrocasting of Ni layers 39*a*, 39*b*. Preferably, average diameters of the abrasive grains 40*a*, 40*b* are not smaller than 100 μm and not greater than 270 82 m respectively. If the average diameters of the abrasive grains 40*a*, 40*b* are smaller than 100 μm, the grinding stones 36*a*, 36*b* are clogged easily by sludge produced during chamfering. Furthermore, the abrasive grains 40*a*, 40*b* wear prematurely, thereby reducing the productivity. On the other hand, if the average diameters of the abrasive grains 40*a*, 40*b* are greater than 270 μm, the number of chippings increases when a fragile work 85 (to be described later) such as a rare-earth sintered magnet is chamfered, since the diameters of the abrasive grains 40*a*, 40*b* are too large. Especially, Such a problem is apt to occur in the case where the work 85 is thin.

The grinding stones 36*a*, 36*b* described above are disposed in such a way that respective tapered portions 42*a*, 42*b* for chamfering are opposed to each other, and connected with each other by a screw 44. A bearing 46 is placed between the grinding stones 36*a*, 36*b*. When chamfering, the bearing 46 is contacted onto a side surface of the work 85, and the grinding stones 36*a*, 36*b* chamfer an upper edge 86*a* and a lower edge 86*b* of the work 85 respectively (See FIG. 5 and FIG. 6.). Depending on a size of the work 85, selection is made between a simultaneous two-surface chamfering and a single surface chamfering. If the work 85 has a thickness not greater than a thickness of the bearing 46 for example, then the grinding stones 36*a*, 36*b* are moved vertically to perform the single surface chamfering to the work 85.

Returning to FIG. 1, the column 18 has an upper surface provided with a cylinder 48 for vertically moving the grinding stone shaft 32. The cylinder 48 has two ends respectively formed with holes 50*a*, 50*b*. The holes 50*a*, 50*b* respectively receives threaded portions 52*a*, 52*b* projecting out of the upper surface of the column 18. The threaded portions 52*a*, 52*b* are provided with blocks 54*a*, 54*b* at positions corresponding to the thickness of the work 85 respectively. The cylinder 48 is connected to the motor attaching portion 24 by an arm 56. With this constitution, the blocks 54*a*, 54*b* limit upward movement of the cylinder 48, and determine a vertical stroke of the cylinder 48, and vertical strokes of the grinding stone shaft 32 and the tool 34 moved vertically by the cylinder 48.

A container 58 is disposed near the base 12. Inside the container 58, a work holding portion 59 is provided for holding the work 85. The work holding portion 59 includes a turntable 60 disposed inside the container 58. The turntable 60 is rotated by a table rotating motor 62 disposed right beneath the container 58 at a speed not slower than 1 rpm and not faster than 10 rpm for example, and in a direction indicated by Arrow B. As shown also in FIG. 3, the turntable 60 has an upper surface provided with a work table 64 on which the work 85 is to be placed.

Figure 4A:
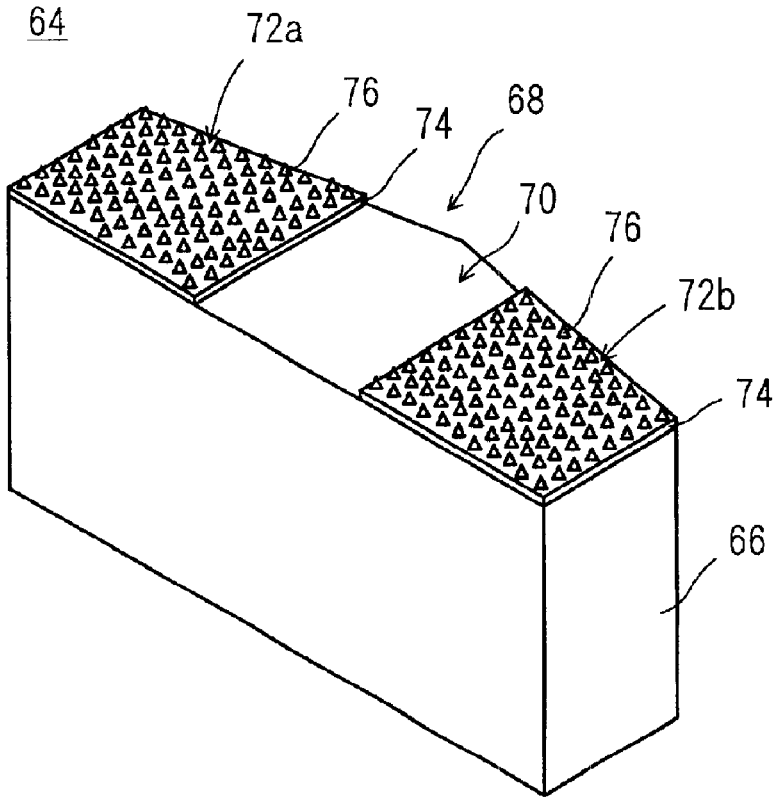
FIG. 4A is a perspective view of a work table.
Figure 4B:
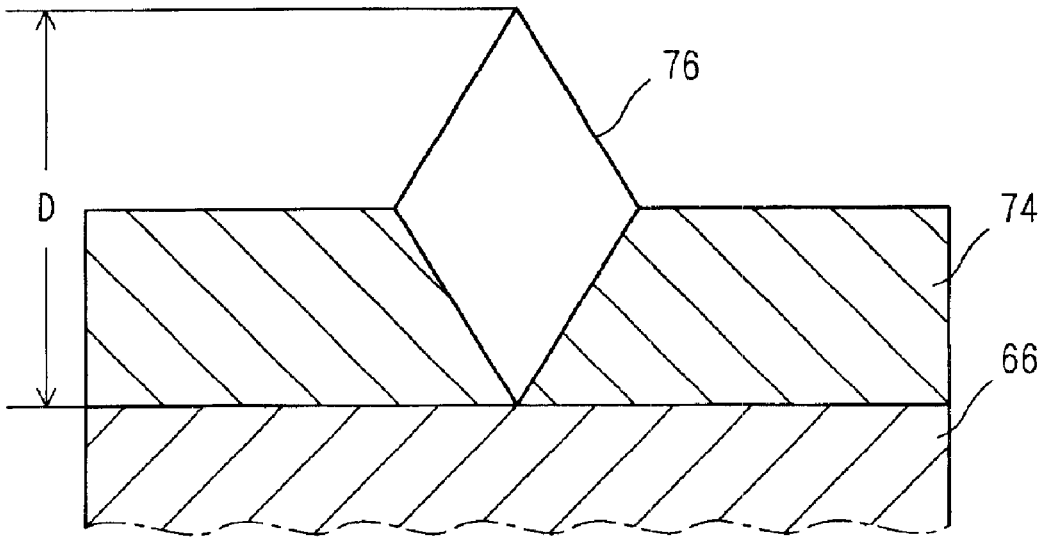
FIG. 4B is a sectional view showing a primary portion thereof.

Referring to FIG. 4A and FIG. 4B, the work table 64 includes a base 66. The base 66 has an upper surface 68 including a center portion 70 and two end portions 72*a*, 72*b* each having a static friction coefficient greater than that of the center portion 70. The static friction coefficient of the end portions 72*a*, 72*b* is greater than 0.1 and smaller than 1.0. The end portions 72*a*, 72*b* are respectively formed with holding grains 76 made of diamond and so on, rendered by electrocasting of Ni layers 74. For example, the Ni layer 74 is formed to a thickness of 50 μm, and the holding grains 76 has a grain diameter D of 100 μm approximately, and the holding grains 76 project out of the upper surface 68. With this constitution, when the work is held, the holding grains 76 stick into the work 85, reducing unwanted movement of the work 85 during the chamfering due to an anchoring effect. Further, by constituting the work holding portion 59 as described above, even if the work 85 is made of a highly abrasive material such as a rare-earth alloy magnet, it becomes possible to apply stable and firm holding force, without causing wear in the work holding portion 59.

The grain diameter D of the holding grain 76 is preferably not smaller than 50 μm and not greater than 300 μm approximately. Within this range, sticking depth of the holding grain 76 into the work 85 can be within an approximate range not smaller than 5 μm and not greater than 10 μm. Therefore, marking of the work 85 can be made shallow, while holding the work 85 firmly due to an anchoring effect.

Figure 3:
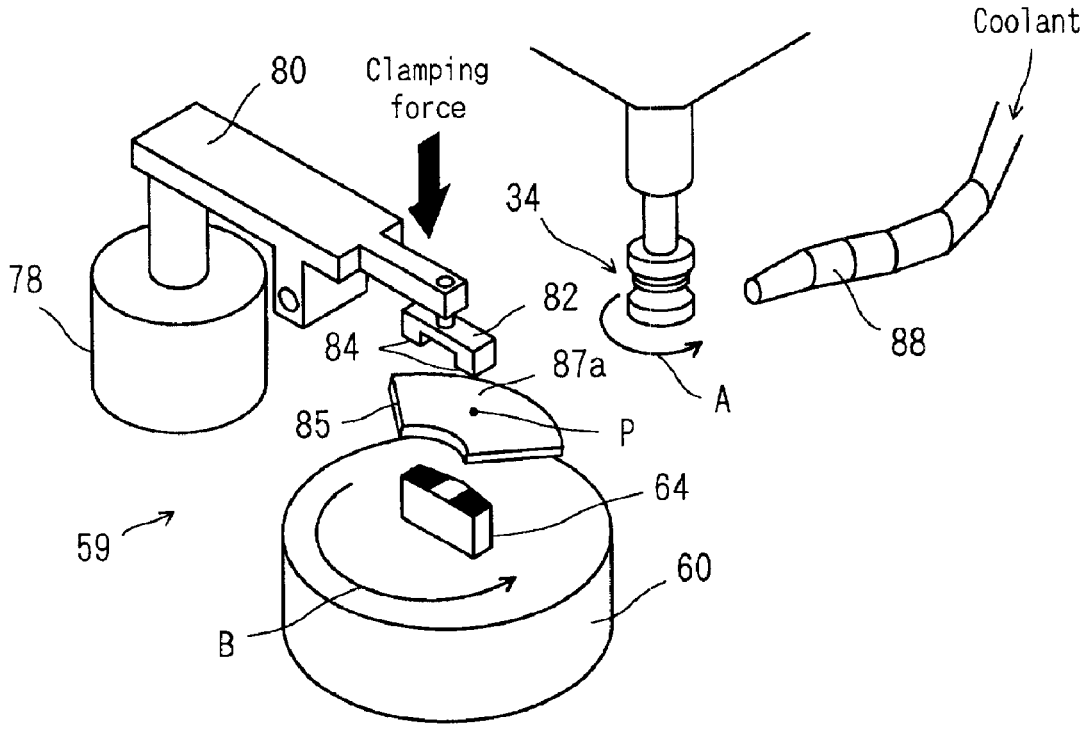
FIG. 3 is a perspective view showing a primary portion of the embodiment in FIG. 1.

As shown in FIG. 1 and FIG. 3, inside the container 58, a clamper 80 operated by a clamping cylinder 78 is disposed. The clamper 80 has a tip provided with a generally U-shaped member 82. The U-shaped member 82 has two ends each having a lower surface 84 (a total of two lower surfaces) contacted onto an upper surface 87*a* of the work 85. In this state, a rotating center P of the work 85 is between the lower surfaces 84, the lower surfaces 84 are apart generally equally from the rotating center P, and the work 85 is pressed at two regions.

With the above constitution, when chamfering, the work 85 is held by the two end portions 72*a*, 72*b* of the work table 64 included in the work holding portion 59 and the lower surfaces 84 at the end portions of the U-shaped member 82.

The present invention can be effective if the work 85 is a hard and fragile work such as a rare-earth alloy magnet for obtaining a magnet used in a voice coil motor for a HDD. When considering the fact that the related art chamfering apparatus in which both the upper and lower edges of the work is chamfered simultaneously can only chamfer the work having a thickness not thinner than 3.0 mm, the present invention can be especially effective, if the work 85 is thinner than 3.0 mm, difficult to hold and has little margin to grind. Further, the present invention is also effective to the work formed into a shape including a curved line such as a sector-shaped work.

Further, in order to supply a coolant to the work 85 when chamfering, a coolant nozzle 88 of a coolant supplying device (not illustrated) is disposed near the work holding portion 59 in the container 58.

The coolant is primarily made of water. The coolant has a surface tension not smaller than 25 mN/m and not greater than 60 mN/m. If the primary ingredient is water, cooling capability is high because of a high specific heat and a high evaporation heat. If the surface tension is not smaller than 25 mN/m and not greater than 60 mN/m, the coolant has a good permeability to grinding edges of the grinding stones 36*a*, 36*b*, improving grinding efficiency.

It should be noted here that an antifoaming agent may be added by the coolant so that rapid temperature increase caused by foaming can be prevented at a grinding region. The additives for the coolant may include a surfactant or synthetic type lubricant, a rust inhibitor, a non-ferrous metal anticorrosive, an antiseptic and an antifoaming agent.

The surfactant added to the coolant including water as a primary ingredient can be an anionic surfactant or a nonionic surfactant. Examples of the anionic surfactant are a fatty acid derivative such as fatty acid soap and naphthenic acid soap; a sulfate ester surfactant such as long-chain alcohol sulfate ester and sulfated oil of animal or vegetable oil; and a sulfonic acid surfactant such as petroleum sulfonate.

Examples of the nonionic surfactant are a polyoxyethylene surfactant such as polyoxyethylene alkylphenyl ether and polyoxyethylene monofatty acid ester; a polyhydric alcohol surfactant such as sorbitan monofatty acid ester; and an alkylol amide surfactant such as fatty acid diethanol amide. Specifically, the surface tension and the coefficient of dynamic friction can be adjusted within the preferred ranges by adding to water approximately 2 wt % of a chemical solution type surfactant, JP-0497N (manufactured by Castrol Limited).

The synthetic type lubricant can be any of a synthetic solution type lubricant, a synthetic emulsion type lubricant and a synthetic soluble type lubricant, among which the synthetic solution type lubricant is preferred. Specific examples of the synthetic solution type lubricant are Syntairo 9954 (manufactured by Castrol Limited) and #870 (manufactured by Yushiro Chemical Industry Co., Ltd.). When any of these lubricants is added to water in a concentration of approximately 2 wt %, the surface tension and the coefficient of dynamic friction can be adjusted within the preferred ranges.

Furthermore, when the coolant includes a rust inhibitor, corrosion of the rare-earth alloy can be prevented. In this embodiment, pH of the coolant is preferably set to 9 through 11. The rust inhibitor can be organic or inorganic. Examples of the organic rust inhibitor are carboxylate such as oleate and benzoate, and amine such as triethanol amine, and examples of the inorganic rust inhibitor are phosphate, borate, molybdate, tungstate and carbonate.

An example of the non-ferrous metal anticorrosive is a nitrogen compound such as benzotriazole, and an example of the antiseptic is a formaldehyde donor such as hexahydrotriazine.

Silicone emulsion can be used as the antifoaming agent. When the coolant includes an antifoaming agent, the coolant can be prevented from foaming up so as to attain high permeability. As a result, the cooling effect can be enhanced, and the temperature increase at the grinding edges of the grinding stones 36*a*, 36*b* can be avoided. Thus, the abnormal temperature increase and the abnormal abrasion of the grinding edges of the grinding stones 36*a*, 36*b* can be suppressed.

Now, primary operations of the work chamfering apparatus 10 with the above constitution will be described.

Figure 5C:
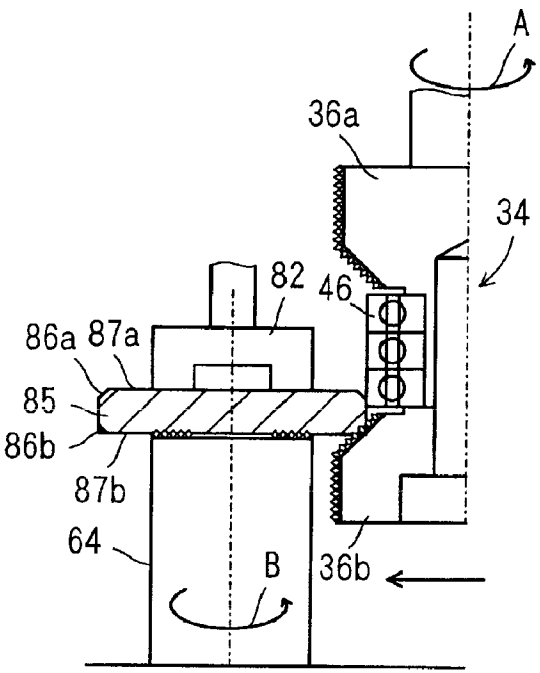
FIGS. 5A~5C are diagrams for describing a single face chamfering according to the embodiment.
Figure 5B:
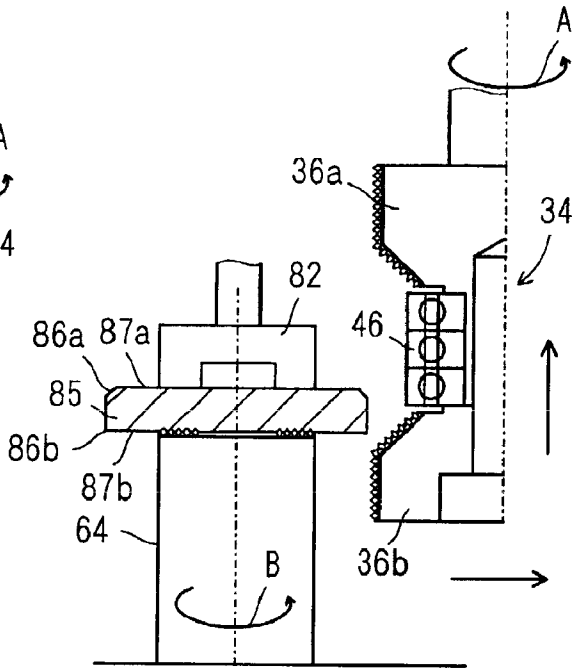
Figure 5A:
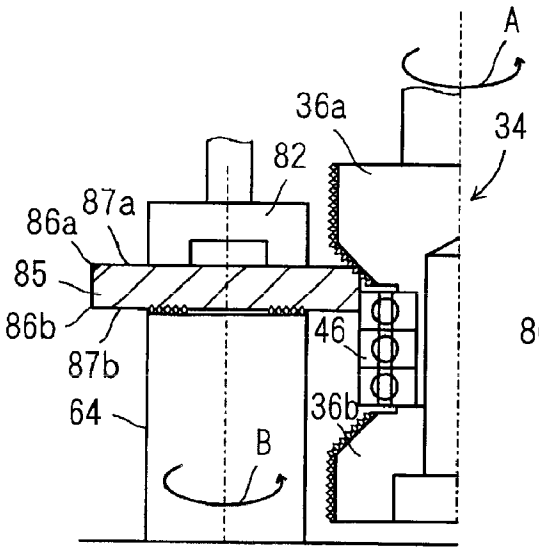

Referring to FIG. 5A~FIG. 5C, description will cover a case in which the upper edge 86*a* and the lower edge 86*b* of the work 85 are chamfered sequentially, one edge at a time. This single surface chamfering is used for example, if the thickness of the work 85 is smaller than the thickness of the bearing 46.

First, as shown in FIG. 5A, the work 85 is held by the work table 64 and the U-shaped member 82 of the clamper 80. At this time, two end portions 72*a*, 72*b* in the upper surface 68 of the work table 64 contact a lower surface 87*b* of the work 85, whereas the lower surfaces 84 of the U-shaped member 82 contact the upper surface 87*a* of the work 85. Next, the tool 34 is lowered, and the grinding stone 36*a* for chamfering the upper edge is contacted to the upper edge 86*a* as a grinding portion of the rotating work 85, so that the upper edge 86*a* is chamfered. Then, as shown in FIG. 5B, the tool 34 is moved off and raised. Then, as shown in FIG. 5C, the grinding stone 36*b* for chamfering the lower edge is contacted to the lower edge 86*b* as a grinding portion of the work 85, so that the lower edge 86*b* is chamfered.

Figure 6:
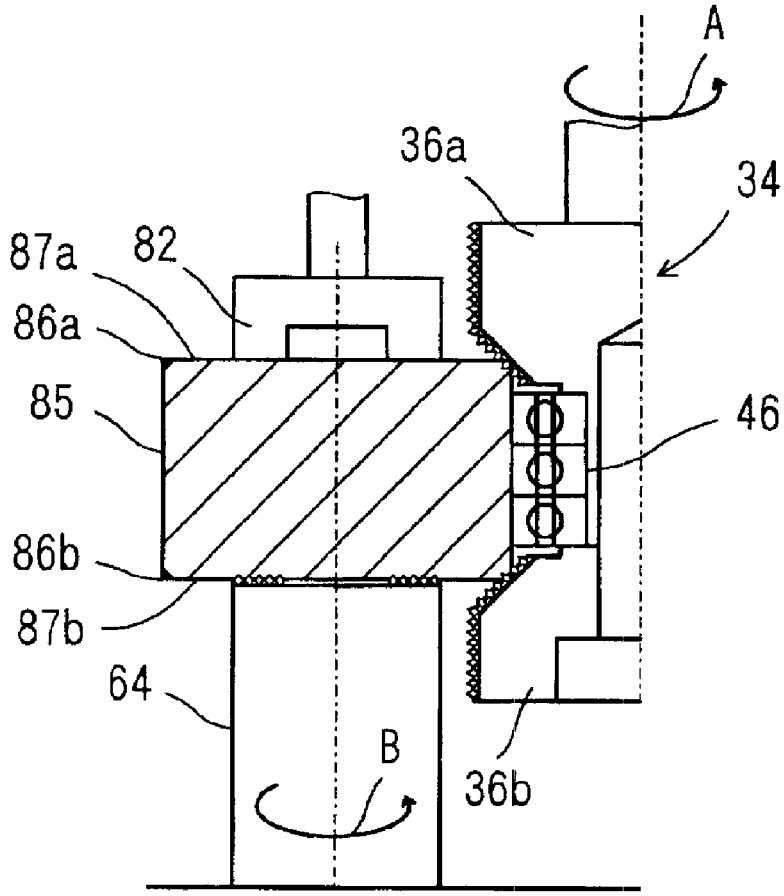
FIG. 6 is a diagram for describing a simultaneous two-face chamfering according to the embodiment.

Next, a case in which both of the upper and lower edges 86*a*, 86*b* of the work 85 are chamfered simultaneously is described with reference to FIG. 6. The simultaneous two-surface chamfering is used if the work 85 is thick enough to contact both grinding stones 36*a*, 36*b* simultaneously.

In this case, chamfering is performed easily, by holding the work 85 with the work table 64 and the U-shaped member 82 of the damper 80 and then by lowering the tool 34 to allow the grinding stones 36*a*, 36*b* to contact the corresponding upper edge 86*a* or the lower edge 86*b* of the rotating work 85.

As has been described above, according to the work chamfering apparatus 10, chamfering can be performed in a mode appropriate to the thickness of the work 85.

Further, as shown in FIG. 5A~FIG. 5C, by shifting the tool 34 vertically, i.e. thickness-wise of the work 85, thereby sequentially chamfering the upper and lower edges 86*a*, 86*b* of the work 85, a variety of works 85 having a variety of thickness can be chamfered easily. It should be noted here that the works 85 of a variety of thickness can be handled without changing the grinding stones 36*a*, 36*b* but by adjusting the stroke of the cylinder 48.

Further, by keeping a constant profile-following pressure, consistency of a chamfering amount X (to be described later) of the upper and lower edges 86*a*, 86*b* of the work 85 can be improved.

Further, according to the work chamfering apparatus 10, the work 85 is held by the end portions 72*a*, 72*b* each having a static friction coefficient greater than 0.1, which is greater than that of the center portion 70 of the work table 64. Therefore, it becomes possible to increase holding force to the work 85. Therefore, even if the work 85 is thin and difficult to hold, unwanted movement of the work 85 caused by grinding reaction during the chamfering can be reduced and the work 85 can be held stably, making possible to chamfer and to increase consistency of the chamfering. Further, since there no longer is need for bonding the work 85 for example, working time can be reduced and the chamfering can be performed efficiently.

Further, since the work 85 is held by the end portions 72*a*, 72*b*, it becomes possible to provide a plurality of regions having a large holding force to the work 85, making possible to further reduce the unwanted movement of the work 85 during the chamfering. Further, since the holding grains 76 can be stack into the work 85 when holding the work 85, the unwanted movement of the work 85 can be reduced due to the anchoring effect even if the clamping force to the work 85 is small.

Further, by holding the work 85 at a plurality of locations (at two locations by the lower surfaces 84 according to the present embodiment), with the rotating center P of rotation of the work 85 in between and with the locations being apart generally equally from the rotating center P, the work 85 can be held evenly on a good balance. Further, the work 85 can be fastened and the unwanted movement of the work 85 during the chamfering can be reduced by a smaller pressing force.

The present invention is effective when the work 85 is a R—Fe—B rare-earth sintered magnet, and is particularly suitable for chamfering a R—Fe—B rare-earth sintered magnet disclosed in the U.S. Pat. Nos. 4,770,723 and 4,792,368. Among others, the present invention is suitable for chamfering and manufacturing a neodymium magnet primarily comprising neodymium (Nd), Iron (Fe) and boron (B), having a hard main phase (iron-rich phase) made of tetragonal intermetallic compound $Nd_2Fe_{14}B$ and a tough Nd-rich grain boundary phase. A typical neodymium magnet is available under a brand name NEOMAX (manufactured by Sumitomo Special Metals Co., Ltd.)

Especially, uniform chamfering is difficult if the work 85 is a fragile R—Fe—B magnet containing cobalt at a rate not smaller than 0.3 wt % and not greater than 10 wt %.

A reason for this is presumed as follows. Specifically, the R—Fe—B magnet is inferior to a Sm—Co magnet in heat resistance. For this reason, if the R—Fe—B magnet is to be incorporated in a product, such as an electric motor, used under a high temperature, the heat resistance is improved by adding Co, which substitute part of Fe, at a rate not smaller than 0.3 wt % and not greater than 10 wt %. On the other hand, the added Co is not only captured in the primary phase but also present in the grain boundary phase and forms such compounds as $R_3CO$ or $R_2CO$, which reduce strength of the R—Fe—B magnet and makes the magnet fragile.

However, according to the present invention, it becomes possible to increase the holding force to the work 85. Therefore, even if the work 85 is a thin, fragile R—Fe—B magnet containing cobalt at a rate not smaller than 0.3 wt % and not greater than 10 wt %, the work 85 can be held stably, and chamfered easily, while reducing chipping.

It should be noted here that as shown in FIG. 3, by rotating the tool 34 in the same direction (Arrow B) as the rotating direction (Arrow A) of the work 85, the load exerted to the work 85 during the chamfering can be reduced and chipping of the work 85 can be reduced.

Next, experiment examples of the work chamfering apparatus 10 will be described.

Experiment conditions are shown in Table 1.

TABLE 1

| | |
|---|---|
| Work | R-Fe-B permanent magnet (NEOMAX-48BH)<br>Dimensions (mm): 40 × 20 × thickness h<br>Thickness h (mm): 1.5, 2.0, 2.5, 3.0<br>Shape: Sector (for VCM use) |
| Grinding stone rotating speed | 3600 rpm |
| Coolant | 10 L/min<br>(Water mixed with 2 wt % of chemical solution) |
| Profile-following load | 24.5 N |
| Grinding stone | Abrasive grain: artificial diamond<br>Mesh: #100<br>Grain Diameter: not smaller than 170 μm and not greater than 210 μm, electrocast<br>Diameter and angle: 20 mm × 45° |
| Clamping force | 588 N |
| Turntable speed | 15 rpm |
| Work table surface | Holding grains: artificial diamond<br>Grain Diameter: not smaller than 90 μm and not greater than 110 μm, electrocast<br>(Surface roughness Rmax = 50 μm, estimation) |
| Measuring location | One discretionary point for each straight portion (upper and lower edges for each surface): A total of four measurements per work |
| Measuring instrument | Dial gage |

As the work 85, a R—Fe—B permanent magnet (NEOMAX-48BH: manufactured by Sumitomo Special Metals Co., Ltd.) having a shape described in Table 1 was used. As the coolant, a chemical solution type coolant JP-0497N (manufactured by CASTROL Limited) mixed with water at an approximate rate of 2 wt % was used, and the coolant was discharged at a rate of 10 litters per minute. The grinding stones 36*a*, 36*b* used had respective tapered portions 42*a*, 42*b* having an average outer diameter of 20 mm with an angle of tilt of 45 degrees. As the abrasive grains 40*a*, 40*b*, artificial diamond grain of mesh #100 (grain diameter: not smaller than 170 μm and not greater than 210 μm) was used. The abrasive grains 40*a*, 40*b* were fastened to the grinding stone 36*a*, 36*b* by means of electrocast respectively. The clamping force was 588N. The turntable 60 was rotated at a speed of 15 rpm (one rotation per 4 seconds). Artificial diamond having a grain diameter not smaller than 90 μm and not greater than 110 μm was fastened to the upper surface of the work table 64 by means of electrocast as in the grinding stones 36*a*, 36*b*, to provide an estimated surface roughness Rmax of 50 μm. The measurements were made by using a dial gage.

First, the work chamfering apparatus 10 and a conventional chamfering apparatus were compared in machinability and working time.

The experiment gave results shown in Table 2.

TABLE 2

| | Work chamfering Apparatus 10 | | Comparative Example 1 (Simultaneous Two-surface chamfering apparatus) | | Comparative Example 2 (Single-surface chamfering apparatus) | |
|---|---|---|---|---|---|---|
| Thickness (mm) | Machinability | Working time (sec) | Machinability | Working time (sec) | Machinability | Working time (sec) |
| 3.0 | ⊙ | 18 | ⊙ | 18 | ⊙ | 300 |
| 2.5 | ⊙ | 35 | X | — | ⊙ | 300 |
| 2.0 | ⊙ | 35 | X | — | ⊙ | 300 |
| 1.5 | ⊙ | 35 | X | — | ⊙ | 300 |

Here, the term "working time" refers to an amount of time used from the point when chamfering of a work 85 is started to a point when chamfering of the next work 85 is started. Table 2 shows an average working time of eight discretionary works 85 picked from four-hundred samples. Further, in the comparative example 1 and the comparative example 2, the works 85 were held by means of bonding with an adhesive.

In Table 2A, Table 3A and Table 3B, symbols ⊙, X and Δ used in the "machinability" column respectively means "possible", "impossible" and "Chamfering was possible but the holding force was not enough that the work 85 moved during the machining".

As shown in Table 2, according to the work chamfering apparatus 10, the working time was increased for the works 85 having a thickness of 2.5 mm or smaller. This is because the upper and the lower edges 86*a*, 86*b* of the works 85 were sequentially chamfered in the single-surface chamfering mode. Further, the comparative example 1 cannot chamfer the work 85 having the thickness smaller than 3.0 mm, so no data is given for the works having the thickness of 2.5 mm and smaller.

As understood from Table 2, according to the work chamfering apparatus 10, even the works having the thickness smaller than 3.0 mm can be chamfered in a short time.

Next, Table 3A and Table 3B show comparison between the work chamfering apparatus 10 and the comparative examples 1~3 in terms of the machinability and chamfering amount inconsistency.

TABLE 3A

| | Work Chamfering Apparatus 10 | | Comparative Example 1 (Simultaneous Two-surface chamfering apparatus) | |
|---|---|---|---|---|
| Thickness (mm) | Machinability | Chamfering amount inconsistency (mm) | Machinability | Chamfering amount inconsistency (mm) |
| 3.0 | ◎ | 0.07 | ◎ | 0.07 |
| 2.5 | ◎ | 0.07 | X | — |
| 2.0 | ◎ | 0.07 | X | — |
| 1.5 | ◎ | 0.07 | X | — |

TABLE 3B

| | Comparative Example 2 (Single-surface chamfering apparatus) | | Comparative Example 3 (Work chamfering apparatus 10 having the work table without diamond) | |
|---|---|---|---|---|
| Thickness (mm) | Machinability | Chamfering amount inconsistency (mm) | Machinability | Chamfering amount inconsistency (mm) |
| 3.0 | ◎ | 0.12 | Δ | 0.5 |
| 2.5 | ◎ | 0.14 | Δ | 0.5 |
| 2.0 | ◎ | 0.14 | Δ | 0.5 |
| 1.5 | ◎ | 0.14 | Δ | 0.5 |

Here, the term "chamfering amount inconsistency" is obtained in the following method.

Figure 7A:
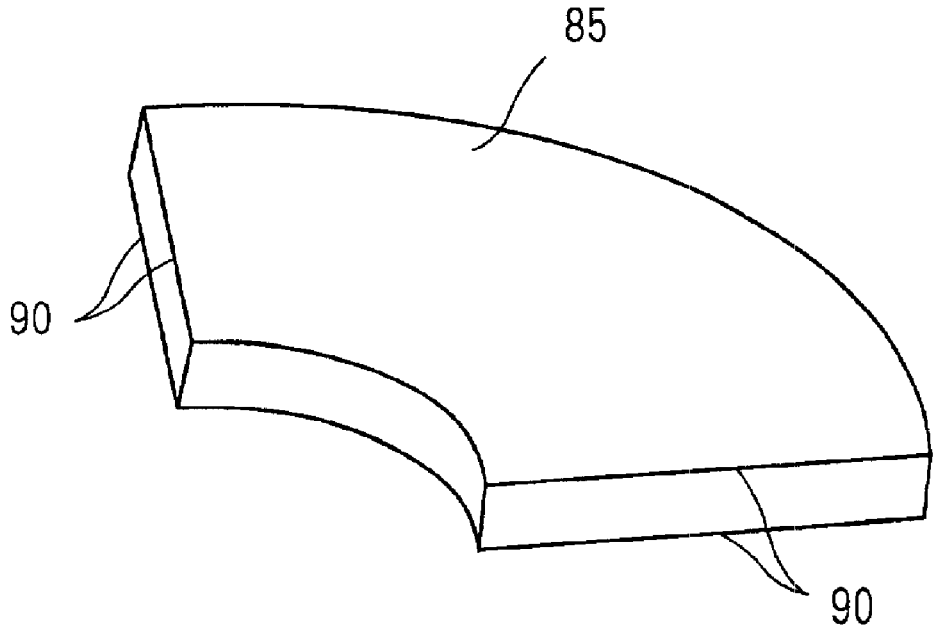
FIG. 7A is a perspective view showing an example of work.
Figure 7B:
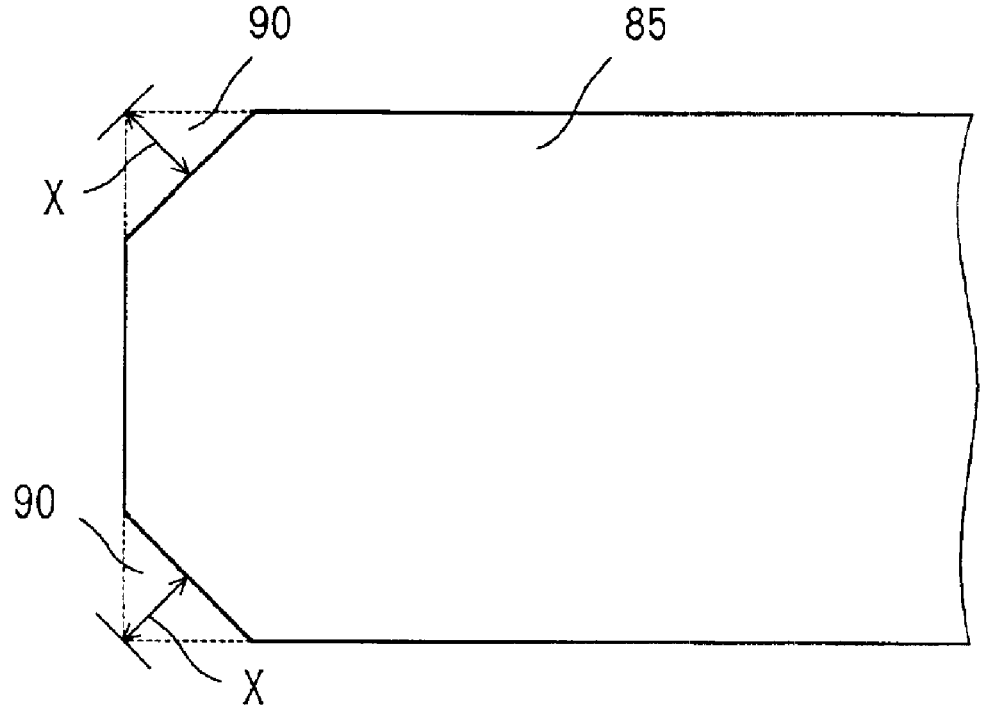
FIG. 7B is a diagram showing a chamfering amount X.

First, the chamfering amount X (See FIG. 7B) is measured at one discretionary point in each of four straight portions 90 of the upper and the lower edges of the work 85 shown in FIG. 7A. Next, difference between a maximum value and a minimum value in the four measurements is obtained. This operation is performed to eight works 85 discretionarily picked from a total of four hundred samples. The eight differences obtained from the eight works are averaged to give the chamfering amount inconsistency.

According to the work chamfering apparatus 10, even if the work 85 is thin, the work 85 can be stably held when chamfering, and unwanted movement of the work 85 when chamfering can be reduced. Therefore, as understood from Table 3A and Table 3B, the chamfering amount inconsistency can be smaller than in the comparative example, resulting in more consistent chamfering.

It should be noted here that the comparative example 3 was the same as the work chamfering apparatus 10 differing only in that the work table 64 was not formed with the diamond. In this comparative example, the chamfering amount inconsistency increases if the thickness of the work is not greater than 3.0 mm, because the work 85 is moved by grinding reaction during the chamfering. This supports the effectiveness of the formation of the holding grains 76 in the surface 68 of the work table 64.

From the results of experiments described above, efficient and accurate chamfering is possible according to the work chamfering apparatus 10.

Figures 8A, 8B:
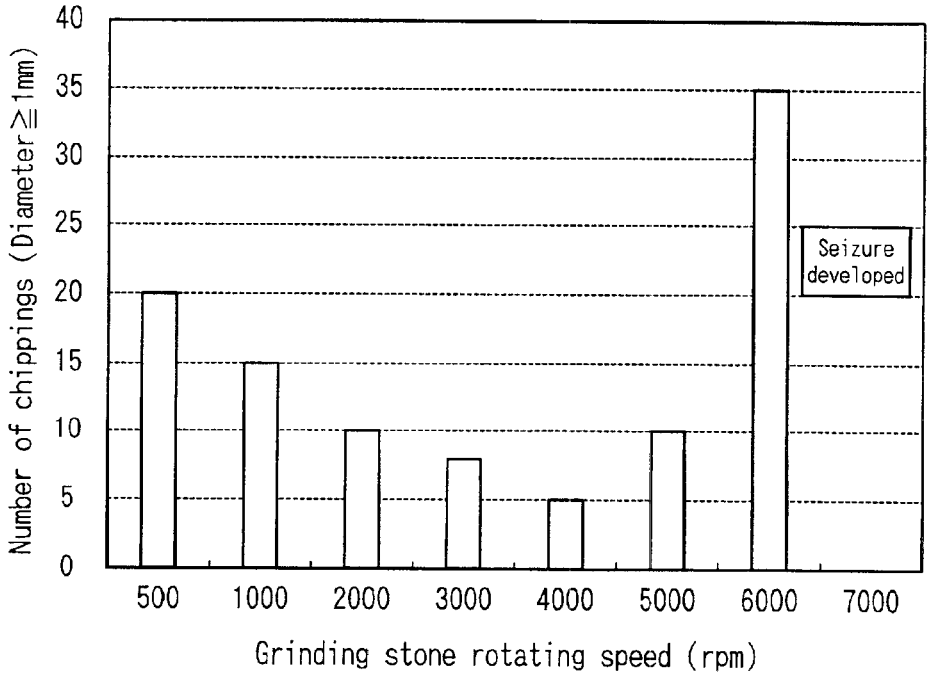
FIG. 8A is a table showing results of an experiment example.
FIG. 8B is a graphical representation thereof.

Further, relationship between rotating speed of the grinding stone and chipping in the work chamfering apparatus is shown in FIG. 8A and FIG. 8B. In this experiment, relative speed of the grounding stones 36*a*, 36*b* to an outer circumference portion of the work 85 was set to 3 mm/sec, and the chamfering amount X was set to 0.14 mm.

In this experiment example, the grinding stone rotating speed was varied within a range not smaller than 500 rpm and not greater than 7000 rpm. The work 85 was chamfered at each of the varied rpm and the number of chippings having a diameter not smaller than 1 mm was counted. Each of the works 85 had the thickness h of 3.0 mm, with the other experiment conditions being equal to those shown in Table 1.

It should be noted that the grinding stone circumferential speed is a circumferential speed of the grinding stone contacted with the work. In this experiment example, the grinding stone circumferential speed was obtained from a formula; grinding stone outer diameter×3.14×grinding stone rotating speed. The grinding stone outer diameter was provided by an average outer diameter of the tapered portion of the grinding stone, and the actual value used in this experiment was 20 mm.

From the results of the experiment, the grinding stones 36*a*, 36*b* should preferably be rotated at a speed not slower than 2000 rpm and not faster than 5000 rpm. In other words, the circumferential speed of the grinding stones 36*a*, 36*b* should preferably be not slower than 125.6 m/min and not faster than 314 m/min.

If the grinding stone rotating speed is slower than 2000 rpm (i.e. the circumferential speed of 125.6 m/min), and if the relative speed of the grinding stones 36*a*, 36*b* i not slower than 3 mm/sec, the grinding stones 36*a*, 36*b* exert large grinding load, resulting in an i creased number of chippings in the work 85. If the relative speed of the grinding stones 36*a*, 36*b* is decreased, the chipping is eliminated but operation efficiency goes down to an extremely low level. On the other hand, if the grinding stone rotating speed is faster than 5000 rpm (i.e. the circumferential speed of 314 m/min), the coolant is not supplied to the grinding edge enough, and the number of chippings increases. Further, if the rotating speed exceeds 6000 rpm (i.e. the circumferential speed of 376.8 m/min), accompanying air flow around the grinding stones becomes too strong and the supply of coolant to the grinding region becomes insufficient, resulting in a seizure.

Even if the work 85 is a R—Fe—B magnet containing cobalt not smaller than 0.3 wt % and not greater than 10 wt %, the number of chippings can be reduced and the chamfering can be efficient if the grinding stone rotating speed is not slower than 2000 rpm and not faster than 5000 rpm, i.e. if the grinding stone circumferential speed is not slower than 125.6 m/min and not faster than 314 m/min. At this time, if the relative speed of the grinding stones 36*a*, 36*b* with respect to the outer circumferential portion of the work 85 is slower than 0.5 mm/sec, the grinding efficiency goes down, on the other hand, if the relative speed is faster than 7.0 mm/sec. the grinding stones 36*a*, 36*b* exert large machining load, resulting in an increased number of chippings in the work 85. Therefore, the relative speed is not slower than 0.5 mm/sec and not faster than 7.0 mm/sec, and more preferably, not slower than 2.0 mm/sec and not faster than 4.0 mm/sec.

More preferably, the grinding stone rotating speed is not slower than 3000 rpm and not faster than 4000 rpm, i.e. the grinding stone circumferential speed is not slower than 188.4 m/min and not faster than 251.2 m/min. In this case, the number of chippings can be further reduces.

It should be noted here that the portion having the static friction coefficient exceeding 0.1, i.e. the portion having a surface including the holding grains 76 projecting out of the surface, may alternatively be formed in the lower surfaces 84 of the U-shaped member 82, or may be formed both in the upper surface 68 of the work table 64 and the lower surfaces 84 of the U-shaped member 82.

Further, according to the embodiment, the work 85 is held on the upper surface 87*a*. However, the work 85 can alternatively be held by the lower surface 87*b* of the work 85, or both of the upper and lower surfaces 87*a*, 87*b* of the work 85, by a plurality of locations, with the rotating center P of the work 85 being between the locations and the locations being apart generally equally from the rotating center P. The number of locations for holding the work 85 may be three or more per surface of the work 85.

The holding grains 76 formed on the base 66 of the work table 64 may be grains of such a substance as $Al_2O_3$, SiC, cBN and so on.

It should also be noted here that in the present invention, the term rare-earth alloy refers to a concept including the rare-earth magnet. A rare-earth magnet is obtained by magnetizing a rare-earth alloy. The magnetization can be performed before or after the grinding step. The present invention can be applicable to the work 85 made of any rare-earth alloy. A rare-earth magnet manufactured from a R—Fe—B rare-earth alloy is suitable as a material for a voice coil motor used in positioning a magnetic head.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A work chamfering method using a work holding portion including a first surface and a second surface, the first surface of the work holding portion including a portion having a static friction coefficient greater than 0.1, the method comprising:

a first step of holding a work with the work holding portion by contacting the first surface of the work holding portion with a first main surface of the work and by contacting the second surface of the work holding portion with a second main surface of the work; and a second step of chamfering the work by using a tool;

wherein the work holding portion is adapted to rotate the work around a center of rotation;

further wherein the first surface of the work holding portion contacts the first main surface of the work at at least two remote contacting locations on the first main surface, the second surface of the work holding portion contacts the second main surface of the work at at least two remote contacting locations on the second main surface;

further wherein the center of rotation is between the contacting locations;

further wherein the work is a substantially plate segment formed into a shape including a curved line, and further wherein said work is a segment of a ring.

2. The method according to claim 1, wherein the portion having the static friction coefficient greater than 0.1 is formed at two end portions of the first surface of the work holding portion, and the two end portions contacting the first main surface of the work in the first step.

3. The method according to claim 1, wherein the portions having the static friction coefficient greater than 0.1 stick into the work in the first step.

4. A work chamfering method using a work holding portion including a first surface and a second surface, the first surface of the work holding portion including a center portion and two end portions, each of the two end portions having a static friction coefficient greater than that of the center portion, the method comprising:

a first step of holding a work with the work holding portion by contacting each of the two end portions of the first surface of the work holding portion with a first main surface of the work and by contacting the second surface of the work holding portion with a second main surface of the work; and a second step of chamfering the work by using a tool;

wherein the work holding portion is adapted to rotate the work around a center of rotation;

further wherein the first surface of the work holding portion contacts the first main surface of the work at at least two remote contacting locations on the first main surface, the second surface of the work holding portion contacts the second main surface of the work at at least two remote contacting locations on the second main surface;

further wherein the center of rotation is between the contacting locations;

further wherein the work is a substantially plate segment formed into a shape including a curved line, and wherein said work is a segment of a ring.

5. The method according to one of claims 1 or 4, wherein the tool includes a first grinding stone and a second grinding stone, and the second step includes a sub-step of chamfering one edge of the work with the first grinding stone, a sub-step of moving the tool thickness-wise of the work, and a sub-step of chamfering another edge of the work with the second grinding stone.

6. The method according to claim 1, wherein the work is a R—Fe—B alloy containing cobalt at a rate not smaller than 0.3 wt % and not greater than 10 wt %.

7. The method according to claim 1, wherein the tool includes a grinding stone, and the grinding stone being rotated at a speed not slower than 2000 rpm and not faster than 5000 rpm for chamfering the work in the second step.

8. The method according to claim 1, wherein the tool includes a grinding stone, and the grinding stone being rotated at a circumferential speed not slower than 125.6 m/min and not faster than 314 m/min for chamfering the work in the second step.

9. A chamfering method for chamfering a rare-earth sintered magnet, comprising the steps of:

applying a grinding stone to the magnet to perform the chamfering;

rotating the grinding stone at a speed not slower than 2000 rpm and not faster than 5000 rpm, and controlling the relative speed of the grinding stone with respect to an outer circumferential portion of the rare-earth sintered magnet to be not slower than 0.5 mm/sec and not faster than 7.0 mm/sec.

10. A chamfering method for chamfering a rare-earth sintered magnet, comprising the steps of:

applying a grinding stone to the magnet to perform the chamfering;

rotating the grinding stone at a circumferential speed not slower than 125.6 m/min and not faster than 314 m/min, and controlling the relative speed of the grinding stone with respect to an outer circumferential portion of the rare-earth sintered magnet to be not slower than 0.5 mm/sec and not faster than 7.0 mm/sec.

11. The method according to claim 9 or 10, wherein the grinding stone includes an abrasive grain having an average diameter not smaller than 100 $\mu$m and not greater than 270 $\mu$m.

12. The method according to claim 9 or 10, further comprising the step of supplying a coolant having a surface tension not smaller than 25 mN/m and not greater than 60 mN/m to a grinding region.

13. The method according to claim 9, or 10, wherein the rare-earth sintered magnet contains cobalt at a rate not smaller than 0.3 wt % and not greater than 10 wt %.

* * * * *